US006760919B2

(12) United States Patent
Motooka et al.

(10) Patent No.: US 6,760,919 B2
(45) Date of Patent: Jul. 13, 2004

(54) GLOVE FOR BASEBALL OR SOFTBALL

(75) Inventors: Ken Motooka, Osaka (JP); Masaki Terashita, Osaka (JP); Kazuhiro Kume, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 10/329,790

(22) Filed: Dec. 26, 2002

(65) Prior Publication Data

US 2004/0016038 A1 Jan. 29, 2004

(30) Foreign Application Priority Data

Jul. 29, 2002 (JP) ..... 2002-219949

(51) Int. Cl.[7] ..... A41D 13/08
(52) U.S. Cl. ..... 2/19; 2/161.1
(58) Field of Search ..... 2/16, 19, 159, 2/160, 161.1, 161.6, 163, 169; 473/458

(56) References Cited

U.S. PATENT DOCUMENTS 1,567,658 A * 12/1925 Latina ..... 2/19
1,631,735 A * 6/1927 Kennedy et al. ..... 2/19
5,075,899 A * 12/1991 Funahashi et al. ..... 2/19
6,182,289 B1 * 2/2001 Brown ..... 2/19
6,405,380 B1 * 6/2002 Kuroda et al. ..... 2/161.1

FOREIGN PATENT DOCUMENTS

| | | |
|---|---|---|
| JP | 55-73675 | 5/1980 |
| JP | 62-160984 | 10/1987 |
| JP | 7-27651 | 5/1995 |

* cited by examiner

*Primary Examiner*—Gary L. Welch
(74) *Attorney, Agent, or Firm*—Troutman Sanders LLP; Gerald R. Boss

(57) ABSTRACT

A glove for baseball or softball includes a thumb stall receiving a thumb, an index finger stall receiving an index finger, a middle finger stall receiving a middle finger, a ring finger stall receiving a ring finger, a little finger stall receiving a little finger, a back portion located on a back surface and covering the back of a hand, a web portion provided between the thumb stall and the index finger stall, and a hand inserting portion for inserting a hand into the glove. On the back surfaces of the index finger stall, the middle finger stall and the ring finger stall, thin leather portions are provided, which are curved toward the thumb stall on the back portion.

6 Claims, 2 Drawing Sheets

GLOVE FOR BASEBALL OR SOFTBALL

CLAIM OF PRIORITY

This application claims priority from Japanese Patent Application Serial No. 2002-219949, and bearing filing date of Jul. 29, 2002.

BACKGROUND OF THE INVENTION

1. Field of the Invention

The present invention relates to a glove for baseball or softball (hereinafter, simply referred to as a "glove"), and more particularly, to a structure of a back portion effective for keeping a rounded shape of the glove, readily accommodating a ball.

2. Description of the Background Art

Conventionally, a thin leather piece is sewn on a back surface center portion of each finger stall for implementing a rounded shape thereof and for reinforcement. Generally, the thin leather piece is provided on the back surface center portion of each finger stall substantially straight toward a hand inserting opening so as to extend in a longitudinal direction of each finger stall.

For example, in a glove described in Japanese Utility Model Laying-Open No. 55-75365 or Japanese Utility Model Laying-Open No. 7-27651, a thin leather piece is provided on the back surface center portion of each finger stall substantially straight toward a hand inserting opening so as to extend in a longitudinal direction thereof.

In a glove described in Japanese Utility Model Laying-Open No. 62-160984, a thin leather piece is sewn on a finger insertion portion so as to extend vertically as far as a finger inserting base. Then, the thin leather piece is curved outwardly on a back leather portion, and an end portion of the thin leather piece is sewn to a knuckle portion of a little finger inserting portion.

In the glove described in Japanese Utility Model Laying-Open No. 55-75365 or Japanese Utility Model Laying-Open No. 7-27651, however, the thin leather piece is merely provided to extend straight on the back surface center portion of each finger stall. Therefore, it is not possible to keep the overall glove in a rounded shape readily accommodating a ball.

The glove described in Japanese Utility Model Laying-Open No. 62-160984 can be folded along a curve of the thin leather piece. That is, the glove is easily folded inwardly. On the other hand, it is impossible to keep the overall glove in a rounded shape readily accommodating a ball.

SUMMARY OF THE INVENTION

The present invention is made to solve the above-described problems. An object of the present invention is to provide a glove for baseball or softball, capable of keeping an overall, rounded shape readily accommodating a ball.

A glove for baseball or softball according to the present invention includes first, second, third, fourth and fifth finger stalls receiving a thumb, an index finger, a middle finger, a ring finger and a little finger respectively; a web portion provided between the first and second finger stalls; and thin leather portions (lines or members of a small width) attached respectively on back surfaces of the first, second, third, fourth and fifth finger stalls. The thin leather portions on the second and third finger stalls are curved from knuckle portions of the second and third finger stalls toward the first finger stall.

By curving the thin leather portions on the second and third finger stalls from the knuckle portion of each finger stall toward the first finger stall, the thin leather portion can extend in a direction intersecting a longitudinal direction of each finger stall on a back portion of the glove. Therefore, the glove is kept in a shape rounded in a direction intersecting the longitudinal direction of the finger stall, that is, a direction from the knuckle portions of the second and third finger stalls toward the knuckle portion of the first finger stall.

The thin leather portions on the above-described second and third finger stalls preferably extend substantially in parallel between the knuckle portions of the second and third finger stalls and the knuckle portion of the first finger stall. Thus, the shape of the glove can be kept with two thin leather portions substantially in parallel. In other words, the thin leather portion can improve a function to keep the shape of the glove.

Preferably, the thin leather portion on the above-described second finger stall is curved along the web portion, and the thin leather portion on the third finger stall extends toward the knuckle portion of the first finger stall. Accordingly, the glove can be kept in a shape rounded in a direction from the knuckle portion of the first finger portion receiving the thumb toward the knuckle portions of the second and third finger stalls respectively receiving the index finger and the middle finger. Thus, the glove can be kept in a shape readily accommodating the ball.

The thin leather portion on the second finger stall and the thin leather portion on the first finger stall can integrally be formed. Thus, the thin leather portion can be provided to surround the web portion, of which circumference can be reinforced. Therefore, wear of the circumference of the web portion due to the use can be suppressed.

Preferably, the thin leather portion on the above-described fourth finger stall is curved from the knuckle portion of the fourth finger stall toward the first finger stall. In this case, the thin leather portions on the second, third and fourth finger stalls preferably extend substantially in parallel from the knuckle portions of the second, third and fourth finger stalls toward the first finger stall. Thus, by curving also the thin leather portion on the fourth finger stall toward the first finger stall, the shape of the glove can be kept with three members. In other words, the thin leather portion can further improve a function to keep the shape of the glove.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
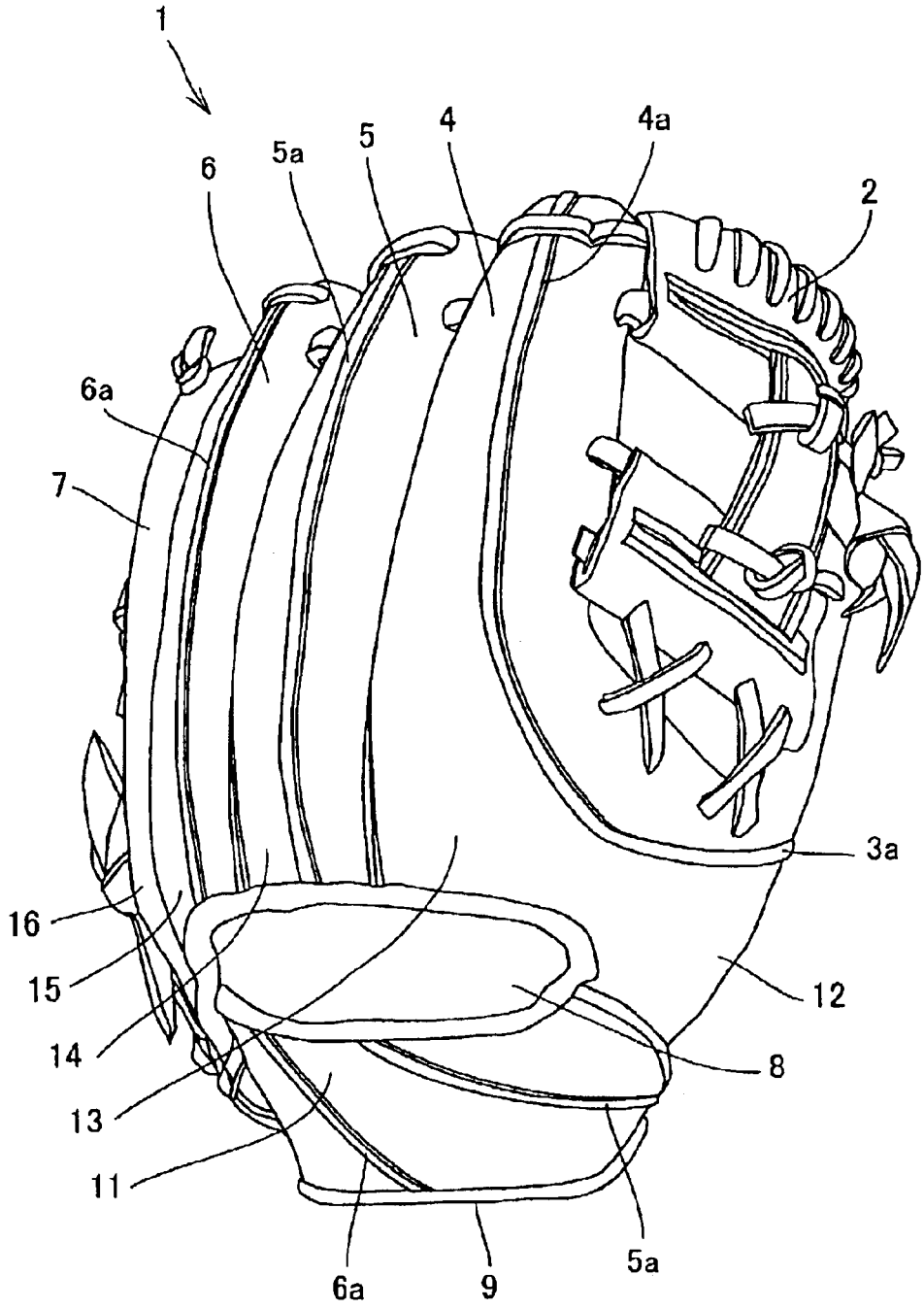
FIG. 1 is a rear view of a glove for baseball or softball in one example of the present invention.

A glove for baseball or softball is fabricated by combining a palm member forming a ball catch face positioned on a palm side to receive a ball with a back member covering the back side of a hand. The glove usually includes a palm portion including the ball catch face, a back portion positioned on the back surface, five finger stalls receiving each finger of a player's hand, a web portion provided between prescribed finger stalls, and a hand inserting portion for inserting a hand into the glove.

The finger stall includes a first finger stall receiving a thumb, a second finger stall receiving an index finger, a third finger stall receiving a middle finger, a fourth finger stall receiving a ring finger, and a fifth finger stall receiving a little finger. The web portion is provided between the first and second finger stalls. The hand inserting portion is formed with an opening provided at one end of the glove.

On the back surfaces of the first to fifth finger stalls, a member for reinforcing the finger stalls and implementing a rounded shape thereof is attached. Typically, the member is fabricated with a material of a small width (several millimeter, for example), such as natural leather ("split" and the like), artificial leather or the like, and is sewn on the first to fifth finger stalls and a back portion. Such a member is herein referred to as a "thin leather portion". It is to be understood that a member of a small width fabricated with a material other than leather, having rigidity higher than a back member and attaining the above-described function, is also included in a concept of the "thin leather portion" of the present invention.

In the present invention, an extending direction of the thin leather portion is featured. Specifically, the thin leather portion is curved from knuckle portions of the finger stalls other than the first finger stall toward the first finger stall. The thin leather portion usually extends in a longitudinal direction from a tip end toward the knuckle portion of the finger stall on the back surface center portion located on the back side of the finger stall. In the present invention, however, the thin leather portion is further extended and curved on the back portion, and it extends from the knuckle portions of the finger stalls other than the first finger stall toward the first finger stall. Therefore, the thin leather portions extend in a direction intersecting the longitudinal direction of the finger stall on the back portion, and they form a plurality of lines (portions with a small width) curved in a direction from the knuckle portions of the finger stalls other than the first finger stall toward the first finger stall on the back portion.

When the thin leather portions are curved toward the first finger stall on the back portion as described above, the glove can be kept in a shape rounded in a diagonal or transverse direction from the knuckle portions of the finger stalls other than the first finger stall toward the first finger stall. Consequently, the glove can be kept in an overall, rounded shape, that is, a shape readily accommodating a ball.

When the glove maintaining the above-described shape is worn on a hand, the hand will be in a shape close to that just before grabbing a ball with a bare hand. When catching a ball, the ball can be accommodated in the glove if only the glove is held out to the direction of the hit ball, and then the glove is simply closed after the ball enters the glove. Here, since it is necessary only to close the hand opened in the glove, the glove can easily be closed. Therefore, even a beginner can easily catch the ball.

It is in particular effective to curve the thin leather portions on the back surfaces of the second and third finger stalls from the knuckle portions of the second and third finger stalls toward the first finger stall. The thin leather portion on the back surface of the second finger stall has only to extend from the knuckle portion of the second finger stall toward the knuckle portion of the first finger stall, while the thin leather portion on the back surface of the third finger stall has only to extend from the knuckle portion of the third finger stall toward the knuckle portion of the first finger stall.

Thus, the glove is kept in an ideally rounded shape, and the shape of a hand when wearing the glove can further be closer to that just before grabbing the ball with a bare hand. Therefore, in catching a ball, the glove can be closed by moving fingers as in grabbing the ball with a bare hand.

Preferably, the thin leather portions on the second and third finger stalls extend substantially in parallel between the knuckle portions of the second and third finger stalls and the knuckle portion of the first finger stall. By providing the thin leather portions in parallel in such a manner, the two thin leather portions can reinforce the glove in a direction intersecting a longitudinal direction of the finger stall. That is, the thin leather portion can improve a function to keep the shape of the glove in that direction.

Preferably, the thin leather portion on the back surface of the second finger stall is curved along the web portion, and reaches the knuckle portion of the first finger stall. Though that thin leather portion may be provided to reach the vicinity of an end portion of the first finger stall in a direction of width, preferably, it is integrally formed with the thin leather portion on the back surface of the first finger stall. In this case, the thin leather portion will surround the web portion, of which circumference can be reinforced. Therefore, it is possible to suppress wear of the circumference of the web portion leading to excessive softness, even after a repeated ball catch.

Preferably, the thin leather portion on the back surface of the third finger stall reaches the knuckle portion of the first finger stall, located on a side of a hand inserting portion rather than an area where the thin leather portion on the back surface of the second finger stall reaches, and passes that knuckle portion to reach the vicinity of the end portion of the first finger stall in the direction of width.

In addition, the thin leather portion on the back surface of the fourth finger stall is curved from the knuckle portion of the fourth finger stall toward the first finger stall. In this case, preferably, the thin leather portions on the back surfaces of the second, third and fourth finger stalls extend substantially in parallel from the knuckle portion of each finger stall toward the first finger stall on the back portion.

Thus, the thin leather portion on the fourth finger stall is also curved toward the first finger stall, whereby three thin leather portions substantially in parallel can reinforce the glove. That is, the thin leather portion can further improve a function to keep the shape of the glove. Here, the thin leather portion on the back surface of the fourth finger stall typically extends in a curve on the back portion, and reaches the vicinity of the hand inserting portion.

Though the thin leather portion is also provided on the back surface of the fifth finger stall receiving the little finger, it extends substantially straight toward the longitudinal direction of the fifth finger stall, and reaches the vicinity of the hand inserting portion, in a manner slightly curved toward the first finger stall on the back portion.

The back portion of the glove covering the back of a player's hand is located between each finger stall and the hand inserting portion. An opening exposing a part of the back of the player's hand may be provided in the back portion. In this case, some of the thin leather portions are discontinuously provided on the back portion. For example, the thin leather portion on the back surface of the third or the fourth finger stall is more likely to be discontinuously provided on the back portion. Even if the thin leather portion is discontinuously provided in such a manner, a function to keep the shape of the glove with the thin leather portion is attained so long as it is curved on the back portion and extends toward the first finger stall.

On the other hand, the opening exposing a part of the back of the player's hand may not be provided. In this case, all thin leather portions are formed continuously on the back portion, and the thin leather portion can more effectively attain the function to keep the shape of the glove.

EXAMPLE

Figure 2:
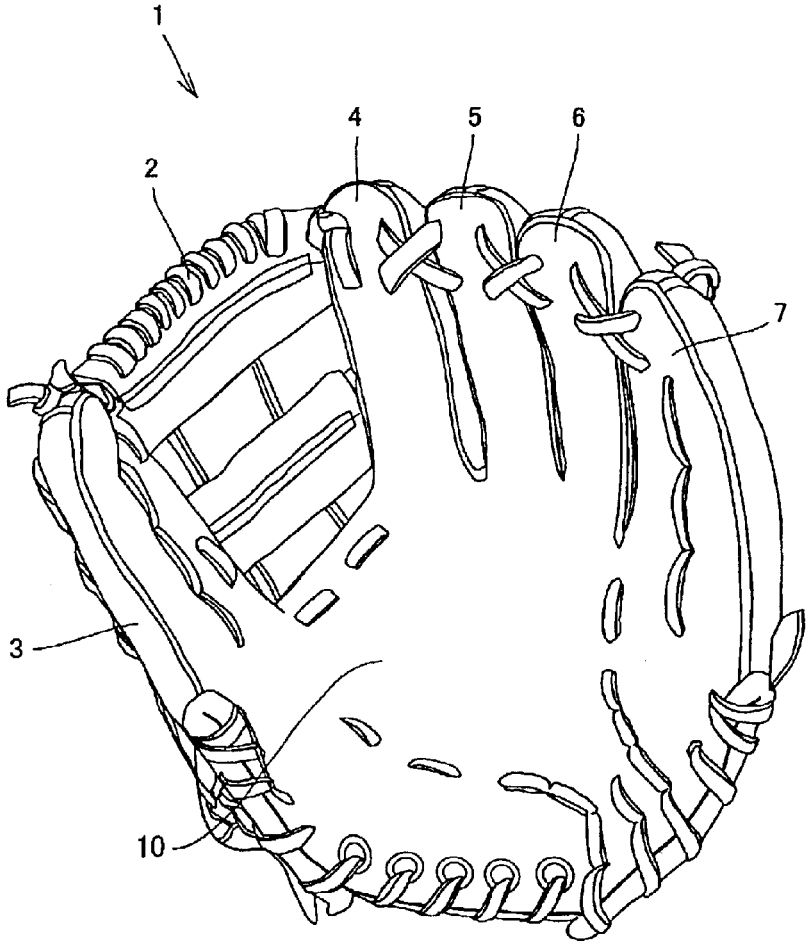
FIG. 2 is a front view of the glove for baseball or softball in one example of the present invention.

In the following, an example of the present invention will be described with reference to FIGS. 1 and 2. As shown in FIGS. 1 and 2, a glove 1 for baseball or softball according to the present invention is fabricated with a material mainly composed of a non-elastic material, such as natural leather, artificial leather or the like. Glove 1 includes a palm portion 10 having a ball catch face, a thumb stall (a first finger stall) 3 receiving a thumb, an index finger stall (a second finger stall) 4 receiving an index finger, a middle finger stall (a third finger stall) 5 receiving a middle finger, a ring finger stall (a fourth finger stall) 6 receiving a ring finger, a little finger stall (a fifth finger stall) 7 receiving a little finger, a back portion 11 located on the back surface and covering the back of a hand, a web portion 2 provided between thumb stall 3 and index finger stall 4, and a hand inserting portion 9 for inserting a hand into glove 1.

As shown in FIG. 1, a thin leather portion 3*a* is provided on the back surface of thumb stall 3, a thin leather portion 4*a* is provided on the back surface of index finger stall 4, a thin leather portion 5*a* is provided on the back surface of middle finger stall 5, and a thin leather portion 6*a* is provided on the back surface of ring finger stall 6. Though not shown, a thin leather portion is also provided on the back surface of little finger stall 7. In the present example, the thin leather portion is fabricated with split, and sewn on each finger stall.

Thin leather portion 3*a* extends from the tip end of the longitudinal direction on the back surface of thumb stall 3 along web portion 2, and is connected to and integrally formed with thin leather portion 4*a*. Thin leather portion 4*a* extends from the tip end of the longitudinal direction of the back surface of index finger stall 4 in the longitudinal direction of index finger stall 4 along web portion 2, curves from a knuckle portion 13 of index finger stall 4 toward thumb stall 3 on back portion 1, and is connected to and integrally formed with thin leather portion 3*a*. Therefore, in the present example, thin leather portions 3*a* and 4*a* surround web portion 2.

Thin leather portion 5*a* extends in a longitudinal direction of middle finger stall 5 from the tip end of the longitudinal direction on the back surface of middle finger stall 5, curves from a knuckle portion 14 of middle finger stall 5 toward thumb stall 3 on back portion 11, and passes a knuckle portion 12 of thumb stall 3 to reach the vicinity of an end portion of thumb stall 3 in a width direction.

In the example in FIG. 1, since an opening 8 exposing a part of a player's hand is provided in back portion 11, thin leather portion 5*a* is interrupted by opening 8, and extends again from a lower end of opening 8 (an end portion on the side of hand inserting portion 9) toward thumb stall 3 on back portion 11. In other words, thin leather portion 5*a* is discontinuously provided on back portion 11. Here, if opening 8 is not provided in back portion 1, thin leather portion 5*a* continuously extends from knuckle portion 14 of middle finger stall 5 toward a knuckle portion 12 of thumb stall 3.

Thin leather portion 6*a* extends from the tip end of the longitudinal direction of the back surface of ring finger stall 6 in a longitudinal direction of ring finger stall 6, curves from a knuckle portion 15 of ring finger stall 6 toward thumb stall 3 on back portion 11, and reaches the vicinity of hand inserting portion 9. Thin leather portion 6*a* is interrupted by opening 8 in a manner similar to thin leather portion 5*a*, and is provided discontinuously on back portion 11. If opening 8 is not provided on back portion 11, thin leather portion 6*a* also continuously extends in a manner curved from knuckle portion 15 of ring finger stall 6 toward thumb stall 3.

The thin leather portion on the back surface of little finger stall 7 extends from the tip end of the longitudinal direction of the back surface thereof in the longitudinal direction of little finger stall 7, slightly curves from a knuckle portion 16 of little finger stall 7 toward thumb stall 3 on back portion 11, and reaches the vicinity of hand inserting portion 9.

By providing the thin leather portion as described above, glove 1 can be kept in a shape desirably rounded in a direction from knuckle portion 12 of thumb stall 3 toward the knuckle portion of each finger stall. Specifically, as shown in FIGS. 1 and 2, for example, glove 1 can be kept in an overall rounded shape, that is, a shape readily accommodating the ball. When inserting a hand in glove 1 of such a shape, the hand will be in a shape closer to that just before grabbing the ball with a bare hand.

A player using glove 1 of such a shape can receive a ball in glove 1 only by holding out glove 1 to a direction of the hit ball. After receiving the ball, the player can easily catch the ball only by closing glove 1.

It is to be noted that the example shown in FIGS. 1 and 2 are by way of illustration, and the present invention is not limited thereto. In particular, the shape readily accommodating a ball is not limited to those shown in FIGS. 1 and 2. For example, a state of the glove slightly closed compared with that shown in FIG. 2 will be sufficient to easily accommodate the ball.

In addition, by adjusting a material, an extending direction and the like of the above-described thin leather portion, glove 1 can be in a shape rounded so as to form a "pocket" in a desired portion on the ball catch face in palm portion 10, for example. In this case, glove 1 realizing further easier ball catch can be obtained. Moreover, though a glove for left hand has been discussed in the example described above, a concept of the present invention is applicable to that for right hand.

According to the present invention, the thin leather portions on the back surfaces of at least the second and the third finger stalls are curved from the knuckle portions of the respective finger stalls toward the first finger stall. Therefore, the glove can be kept in a rounded shape in an extending direction (a direction from the knuckle portions of the second and third finger stalls toward the first finger stall) of the thin leather portion, that is, in a shape readily accommodating a ball. When the glove in such a shape is worn on a hand, the hand in the glove can be in a shape considerably closer to that just before grabbing the ball with a bare hand, and the glove itself will be in a opened state. Therefore, in catching the ball, the player can receive the ball only by holding out the glove to the direction of the hit ball. Thereafter, only by naturally closing the hand as if grabbing the ball with a bare hand, the glove can be closed with that closing movement. Here, the glove is in a rounded shape as described above. Accordingly, when closing the glove, power from the fingers can efficiently be transmitted to the glove, to close the same. Thus, even a beginner can catch the ball easily.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A ball glove for catching a baseball or softball, comprising:

first, second, third, fourth and fifth finger stalls receiving a thumb, an index finger, a middle finger, a ring finger and a little finger respectively;

a web portion provided between said first and second finger stalls; and thin leather portions attached on back surfaces of said first, second, third, fourth and fifth finger stalls respectively; wherein said thin leather portions on said second and third finger stalls are curved from knuckle portions of said second and third finger stalls to said firs; finger stall, thereby holding the ball glove in a generally rounded shape for facilitating the positioning of a user's hand for catching a ball.

2. The glove for baseball or softball according to claim 1, wherein said thin leather portions on said second and third finger stalls extend substantially in parallel between the knuckle portions of said second and third finger stalls and a knuckle portion of said first finger stall.

3. The glove for baseball or softball according to claim 1, wherein said thin leather portion on said second finger stall is curved along said web portion, and said thin leather portion on said third finger stall extends toward the knuckle portion of said first finger stall.

4. The glove for baseball or softball according to claim 3, wherein said thin leather portion of said second finger stall and said thin leather portion on said first finger stall are integrally formed.

5. The glove for baseball or softball according to claim 1, wherein said thin leather portion on said fourth finger stall is curved from a knuckle portion of said fourth finger stall to said first finger stall.

6. The glove for baseball or softball according to claim 5, wherein said thin leather portions on said second, third and fourth finger stalls extend substantially in parallel from the knuckle portions of said second, third and fourth finger stalls to said first finger stall.

* * * * *

UNITED STATES PATENT AND TRADEMARK OFFICE

CERTIFICATE OF CORRECTION

PATENT NO. : 6,760,919 B2
DATED : July 13, 2004
INVENTOR(S) : Motooka et al.

It is certified that error appears in the above-identified patent and that said Letters Patent is hereby corrected as shown below:

Title page,
Item [56], References Cited, FOREIGN PATENT DOCUMENTS,
"JP 55-73675" should be changed to -- JP 55-75365 --

Signed and Sealed this

Sixteenth Day of November, 2004

JON W. DUDAS
*Director of the United States Patent and Trademark Office*